United States Patent [19]

Geleijnse et al.

[11] 3,964,222

[45] June 22, 1976

[54] WOODEN SPIRAL STAIRCASE

[75] Inventors: Johannes Geleijnse; Machiel Geleijnse, both of Vlaardingen, Netherlands

[73] Assignee: Firma M. Geleijnse & Zoon, Vlaardingen, Netherlands

[22] Filed: Jan. 27, 1975

[21] Appl. No.: 544,283

[52] U.S. Cl. ..... 52/187

[51] Int. Cl.[2] ..... E04F 11/00

[58] Field of Search ..... 52/182, 183, 184, 185, 52/186, 187, 188, 189, 190, 191

[56] References Cited

UNITED STATES PATENTS

| | | | |
|---|---|---|---|
| 314,374 | 3/1885 | Gilfillan | 52/182 |
| 367,296 | 7/1887 | Heidland | 52/187 |
| 3,430,729 | 3/1969 | Miceli | 52/187 |
| 3,482,364 | 12/1969 | Albrektson et al. | 52/187 |
| 3,513,547 | 5/1970 | Suckno | 52/187 |

FOREIGN PATENTS OR APPLICATIONS

| | | | |
|---|---|---|---|
| 747,634 | 12/1966 | Canada | 52/190 |
| 2,004,255 | 8/1971 | Germany | 52/187 |
| 106,694 | 12/1942 | Sweden | 52/187 |
| 625,456 | 12/1946 | United Kingdom | 52/187 |

*Primary Examiner*—Ernest R. Purser
*Assistant Examiner*—William Randolph
*Attorney, Agent, or Firm*—Amster & Rothstein

[57] ABSTRACT

A wooden spiral staircase with a central column and treads and riser members disposed spirally around said column. The risers have the shape of an asymmetric "T" and are let into a subjacent tread, a superjacent tread, and the central column, thereby serving to support the treads, which are not directly connected to the central column, but are each additionally connected to a superjacent tread and a subjacent tread at their ends remote from the central column.

6 Claims, 4 Drawing Figures

WOODEN SPIRAL STAIRCASE

The invention relates to a wooden spiral staircase with a central column.

The object of the invention is to provide a wooden spiral staircase with a central column and which, although simple in construction and light in weight, nevertheless satisfies all requirements and can cope with all stresses and in particular also has an appealing appearance, with a spacious view through it which is promoted particularly by the fact that the spiral staircase has no outer side wall, in other words belongs to the so-called cantilever type.

To achieve this object, such a wooden spiral staircase with a central column is according to the invention characterised in that the treads, a direct connection to the central column always being avoided, are secured on the upper edge of the flange part of an asymmetrically T-shaped tread carrier which forms the riser, the said upper edge being let into the underside of the tread as from approximately the middle of the rear half of the lateral edge of the tread which is adjacent to the column, parallel with the front tread edge up to approximately two-thirds of the tread length, the root of the T-web of the said tread carrier, with effect from approximately one-sixth up to one-third of the length of the tread, starting from the central column, being let into the lower tread close to the rear edge thereof. One T-shaped carrier end serves as a tenon over about half the height of the step, is let into and is glued into a fitting hole provided in the column symmetrically in the cross-section of the column, to a depth which projects considerably past the axis of the central column, each tread being moreover also connected to a tread situated beneath it and one situated above it on its outer lateral edge which is remote from the central column.

If, for example, the narrow lateral edge of the tread which is adjacent the column has a width of 8 cm, then a vertical central plane through the riser will be disposed approximately 6 cm behind the front edge of the tread into which the upper edge of the T-flange of the tread intersects.

The T-shaped construction of the tread carrier of which the upper T-flange part corresponding to the dimensioning prescribed by the invention, projects toward the column with approximately half the length of the T-flange part which projects in the opposite direction, gives the staircase an effective appearance of a spacious view. Also due to the provision at the outer edge of each tread, of a connection with an upper and a lower tread, an entirely adequate load-bearing capacity is guaranteed. The central column can thereby be a particularly slender construction. For example, in the case of a round central column, a column diameter of no more than 5 times the thickness of the tread carriers will be quite sufficient. Thus, the column diameter may be less than 10 cm. The weakening of the cross-section of the central column where the tread carriers have their tenons let into and glued in the column, in holes provided for the purpose and the height of which corresponding to the specifications of the invention, is only approximately half the step height, is, when viewed in plan, staggered from tread to tread by in each case a specific angular amount. The weakening suffered by the column by virtue of the holes projecting deeply into it is thus entirely permissible. At the same time, it must also be taken into account that in the final condition, the holes with the tread carrier tenons glued therein are again completely filled.

The disposition of the tread carriers according to the foregoing remarks and determined particularly by static considerations results at the same time in a rearwardly offset location of the riser constituted by the tread carrier, with respect to the leading edges of the treads, the said offset being favorable, having regard to the fact that people will be walking on the staircase. The amount by which the front face of the riser lies in each case behind the front edge of the associated tread, is generally abundantly more than 4 cm.

According to the invention, the tread carriers are expediently made from 2 cm thick plywood, for example birchwood plywood, and they are constructed with rounded off inner angles between T-web and T-flange and with an obliquely rising lower edge to the freely projecting T-flange part, which is particularly favorable in that it gives the staircase according to the invention an attractive appearance. The rounded-off portions avoid concentration of stresses in the tread carriers.

Where, as usual, the wooden spiral staircase has banisters provided with a continuous banister rail secured on banister uprights, then in a further development of the invention, each tread expediently has on its outer lateral edge a part which extends parallel with an outer lateral edge part at the rear of the tread below, while the two treads in each case have these aforementioned parts let into the same post of the banister over a definite depth measurement. In consequence, for mounting of the posts on the treads, in an identical fashion for all posts, two approximately identical recesses may be disposed one above the other in the post, naturally with the exception of the posts at the upper and lower ends of the banister. Thus, a further simplification for manufacture and assembly can be achieved.

In the loaded state, the treads are flexion stressed in various directions by virtue of their parts which project with respect to their support. According to a preferred embodiment of the invention, in the outer lateral edges of the treads, in the middle zone of their width between banister posts — a strip of plywood occupying the middle zone of the tread thickness, is let to some depth into the solid wood of the tread. This plywood is preferably birchwood plywood, of a thickness corresponding at most to approximately one-third of the thickness of the tread. The relatively broad outer lateral edges of the treads which are virtually completely visible due to the absence of outer side walls are therefore not made unattractive by cracks or splits which might otherwise be revealed in the solid wood of the stair tread.

The invention will be explained in greater detail hereinafter with reference to an example of embodiment according to the invention which is illustrated in the attached drawings, in which.

Figure 1:
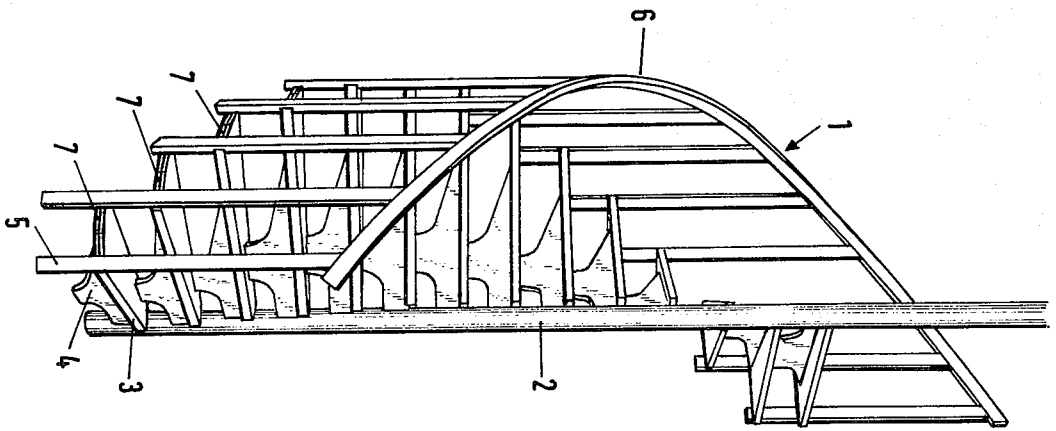
FIG. 1 is a side view of a wooden spiral staircase according to the invention and having no outer side walls.

The drawings show a wooden spiral staircase generally designated 1 and having no outer side walls, a central column 2, treads 3, tread carriers constructed as risers and of substantially asymmetrical T-shape 4, banister posts 5 and a wooden banister rail 6.

The central column 2 consists of three layers of solid mahogany timber glued one onto another. It has a diameter of 9 cm. Also the treads 3 are made from solid mahogany — in a thickness of 3.5 cm, and also the posts 5 — with a profile of 5 × 3 cm and the banister rail with a crosssection of 3.5 × 6 cm. The 2 cm thick tread carriers 4 consist of birch plywood.

Figure 2:
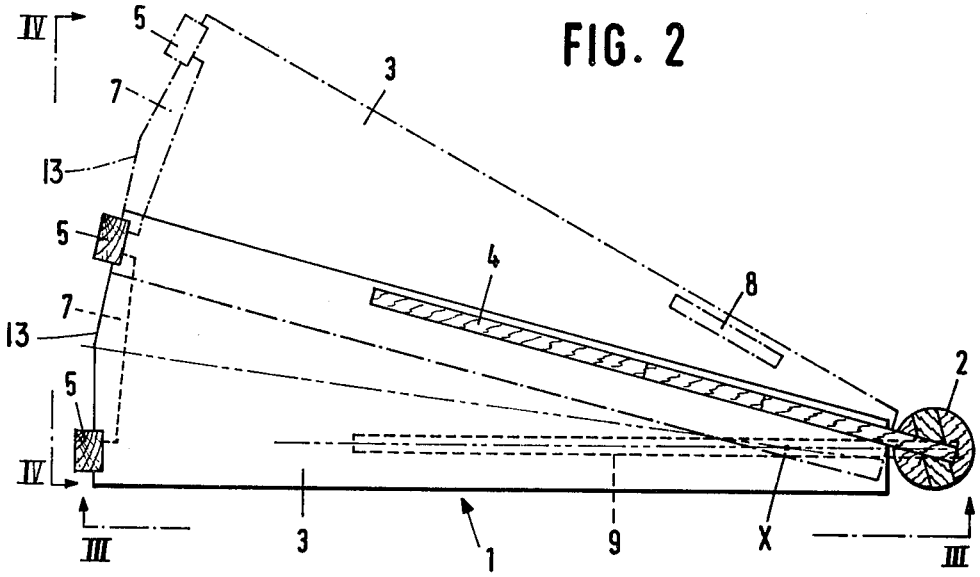
FIG. 2 is a horizontal section, on an enlarged scale, between two treads, with a plan view of the lower tread and — shown by dash-dotted lines — of the tread above it.

On the outer lateral edge of the treads, remote from the central column, there is in the middle zone of the width — between the two banister posts 5 mounted thereon — in the middle zone of the thickness of the tread, a let-in and glued strip 7 of birch plywood, the shape of the strip being shown in plan view in FIG. 2.

The treads have a radial extension of approximately 90 cm measured from the outside of the central column. Their shorter inner lateral edge, 7.5 cm wide in the case of the example of embodiment illustrated, maintains the treads at approximately ½ cm distance from the outside of the column.

In the zone between 14 and 28 cm outside of this narrow lateral edge of the tread, there is, 1 cm inside the rear tread edge, a recess 8 (FIG. 2) 1 cm deep and 14 cm long, let into the upper face of the tread into which the root of the T-web of the tread carrier fit and is glued.

The tread carriers are in each case connected to the treads which happen to be above them, in that their upper edge is in each case, over a length of 60 cm radially outwardly from the narrow lateral edge of the tread, and to a depth of 1 cm, glued into a matching recess (9) (FIG. 2) prepared in this upper tread and the longitudinal central line of which extends 5.5 cm behind and parallel with the leading edge of the upper tread. This central line intersects the longitudinal central line at X (FIG. 2) approximately close to or in the region of the T-web of the tread carrier. The longitudinal central line of the tread also cuts the axis of the central column.

Figure 3:
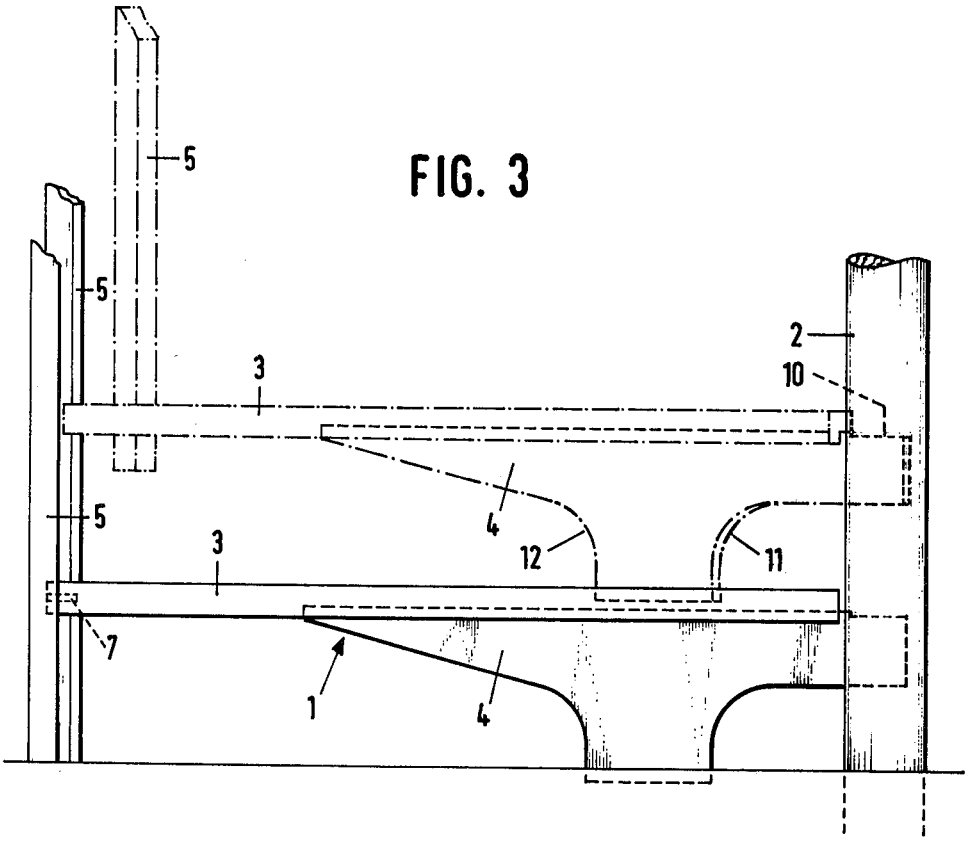
FIG. 3 is a front view according to the line III—III in FIG. 2.

The tread carriers have tenons 10, which are 9 cm high, approximately adjacent their upper edge and extending to a depth of up to 7.5 cm into the column the tenons being glued therein, in a hole prepared in the column. The tenon forms the end of the T-flange part which projects a shortest amount from the T-web. The inner angle between the lower edge of this flange part and one vertical side edge of the T-web is rounded off at 11 in FIG. 3. Reference numeral 12 in the same drawing shows the rounding off in the inner angle between the other vertical lateral edge of the T-web and the lower edge of the opposite, farthest projecting T-flange part. This lower edge extends obliquely outwardly as far as the end of the upper edge part of the tread carrier which is let into the tread above it.

The treads have on their broadest outer lateral edge, approximately 31 cm wide in the example of the embodiment illustrated, an angled shape in plan view, in the centre, at reference numeral 13 (FIG. 2), so that the rear lateral edge part extends parallel with the front lateral edge part of the tread above.

Figure 4:
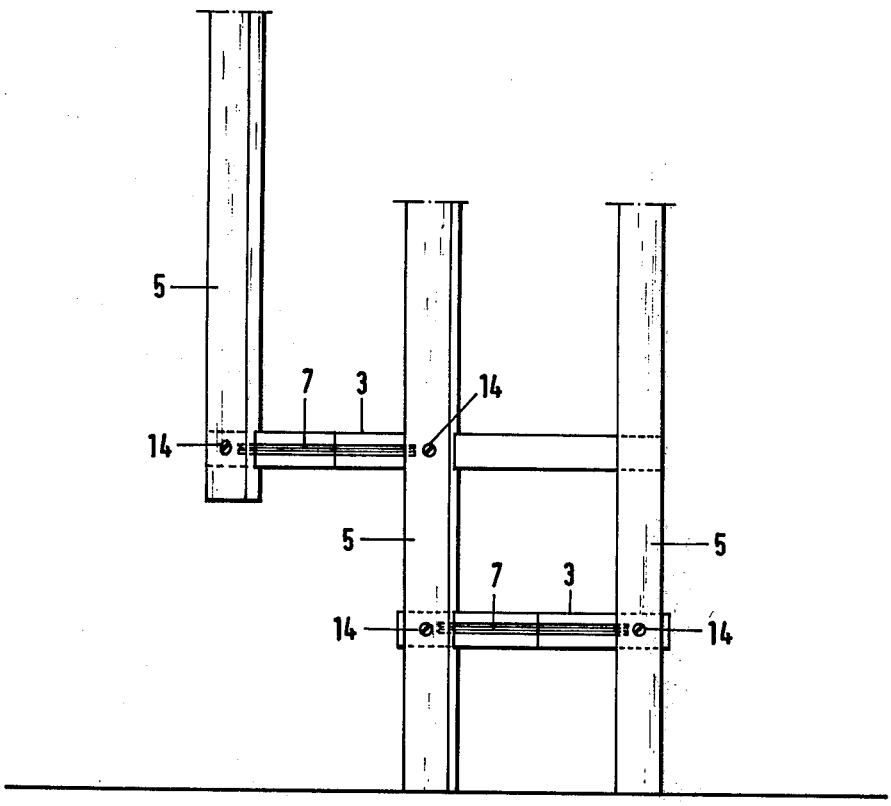
FIG. 4 is a side view according to the line IV—IV in FIG. 2.

In the manner shown in FIG. 2, the posts 5 have, constructed in their narrow sides, two superposed and identical 0.7 cm deep recesses adapted to be engaged by the marginal zones of in each case two consecutive treads. The glued joints are secured by means of screws 14 shown in FIG. 4.

The banister rail 6 (FIG. 1) is mounted on top of the posts by means of pin and hole joints.

Naturally, the invention is not limited to the form of embodiment described hereinabove and illustrated in the drawings; instead, many modifications thereof are possible within the framework of the invention.

We claim:

1. A wooden spiral staircase comprising a central column having a vertical axis;

a plurality of vertically spaced treads, each tread having longitudinally spaced ends and extending transversely with respect to said column, one said end spaced remotely from said column, and the other said end spaced closely adjacent to said column;

a plurality of risers, one each located to extend vertically between said spaced adjacent treads, each said riser including an upper edge and a lower edge with said edges connected by a T-shaped portion;

each said tread on a lower surface thereof having a first elongated recess formed therein extending from said end adjacent said column for a distance approximately two-thirds the length of said tread, and said upper edge of said riser being fitted into said first recess;

each said tread on an upper surface thereof having a second elongated recess formed in an intermediate portion of said tread located in the tread portion closest to said column, and said lower edge of said riser being fitted into said second recess;

adjacent treads having equal spacing therebetween measured vertically along the column surface parallel to said axis of said column;

each said vertical spacing along said column surface having an elongated vertical opening formed therein, each said opening having a vertical measurement approximately half of said vertical spacing;

said plurality of openings corresponding in number to said treads and respectively positioned in alignment with each said riser;

each said riser at the upper part of its T-shaped portion including a tenon fitted into one of said openings, each said tenon extending past said axis of said column to terminate at a distance approximately half-way between said axis and the surface of said column; and means connecting vertically adjacent treads at the ends remote from said column.

2. Wooden spiral staircase according to claim 1 wherein said risers are approximately 2 cm thick, and intermediate edges of said T-shaped portion are curved with the intermediate edge remote from said column extending further upwardly at an oblique angle.

3. Wooden spiral staircase according to claim 1 wherein said means connecting vertically adjacent treads extend further vertically upward to form a plurality of top portions, and a bannister rail is mounted on said top portions.

4. Wooden spiral staircase according to claim 1 wherein the end of each tread remote from said column comprises connected front and rear lateral parts forming an obtuse angle, said rear lateral part of each said tread being parallel to said front lateral part of said vertically spaced adjacent higher tread.

5. Wooden spiral staircase according to claim 4 wherein said connecting means comprises vertically extending posts spaced equally apart, each said posts having two vertically spaced recesses, the lower recess having a portion of said rear lateral part fitted therein, and the upper recess having a portion of said front lateral part fitted therein.

6. Wooden spiral staircase according to claim 1 wherein a reinforcing strip is fitted into the outer end of each said tread, and each said reinforcing strip extends laterally between adjacent connecting means.

* * * * *